United States Patent [19]

Pozzi

[11] Patent Number: 4,962,606

[45] Date of Patent: Oct. 16, 1990

[54] HAMMER SAFETY FOR FIREARMS

[75] Inventor: Oscar A. Pozzi, Sao Leo Poldo/rs, Brazil

[73] Assignee: Amadeo Rossi S.A., Sao Leopoldo, Brazil

[21] Appl. No.: 373,225

[22] Filed: Jun. 29, 1989

[30] Foreign Application Priority Data

Jul. 1, 1988 [BR] Brazil ..... PI88-03286

[51] Int. Cl.[5] ..... F41A 17/74

[52] U.S. Cl. ..... 42/70.08; 42/66

[58] Field of Search ..... 42/66, 70.08

[56] References Cited

U.S. PATENT DOCUMENTS 3,626,623 12/1971 Uberti .
3,748,771 7/1973 Piscetta .
3,838,533 10/1974 Ruger .
4,316,340 2/1982 Kahn .
4,680,884 7/1987 Smith, Jr. et al. .

*Primary Examiner*—Charles T. Jordan
*Assistant Examiner*—Richard W. Wendtland
*Attorney, Agent, or Firm*—Brisebois & Kruger

[57] ABSTRACT

A safety mechanism in which a striker on the hammer can hit the firing pin to discharge the firearm only when the trigger is intentionally pulled and the pull on the trigger is maintained. The striker can move on the hammer and is pushed to the firing position by a weak spring. A safety arm associated with the trigger, pushes the striker to a mis-aligned position in which it cannot hit the firing pin. If the hammer is released accidently by inertial forces, such as dropping or bumping the firearm, the safety arm engages and mis-aligns the striker as the hammer falls, before the striker arrives at the firing pin. Pulling the trigger withdraws the safety arm, but the pull must be maintained until the hammer falls, in order to discharge the firearm.

12 Claims, 2 Drawing Sheets

HAMMER SAFETY FOR FIREARMS

This invention relates generally to a safety mechanism for a firearm, and particularly to a safety mechanism for a firearm having a hammer, the impact of which fires a projectile.

While the invention can be used with various types of firing mechanisms, it is particularly useful for firearms which can be operated in a single action manner, where the hammer is manually retracted to a cocked position before firing.

BACKGROUND OF THE INVENTION

Numerous hammer safety mechanisms of various types are known in the prior art.

While many of these prior mechanisms usually operate in a satisfactory manner, serious injury can occur if there is a minor malfunction, or mishandling which causes accidental and/or unexpected firing.

Among the causes of such accidental firing with known safety mechanisms are mishandling such as dropping or bumping the firearm so inertial forces release a cocked hammer, direct impact on a decocked hammer, accidentally pulling the trigger just far enough to release the hammer, and slipping of the hammer as is it being cocked or decocked.

Mechanical malfunctions such as wear, corrosion, or failure of various parts of the firing mechanism can also cause unexpected firing.

Further, some of the prior safety mechanisms make the firearm unreliable so it will not fire when it is intended to shoot, and many of the prior mechanisms have fragile parts subject to hammer impact, or wear quickly, so the firearm soon becomes useless.

SUMMARY OF THE INVENTION

An object of the present invention is to minimize these difficulties and disadvantages of the prior safety mechanisms.

In accordance with the invention a safety mechanism for firearms is provided in which the firearm will fire only if the trigger is positively manually pulled, and the pull is maintained until the hammer falls to its impact position and discharges the firearm.

The safety mechanism of the invention prevents firing under the following conditions:

1. Accidental slipping or release of the hammer as it is manually moved to the cocked or decocked position.
2. Dropping or bumping the firearm in such a manner that the inertial forces release a cocked hammer, or move the trigger to thus release the hammer.
3. Bumping the hammer while it is down in an uncocked position.
4. Wear of the sear or catch mechanism so the hammer escapes after it latches with the trigger sear.
5. Malfunctions resulting from corrosion and neglect of the firearm.

Firing is prevented under these conditions by providing on the hammer a striker which is biased toward a firing position, but is forced to an out of alignment position in which the firearm cannot fire, unless the trigger is intentionally pulled.

Correspondingly, it is an object of the invention to provide a reliable rugged firing mechanism for a firearm, in which a unique hammer safety minimizes the possibility of accidental firing due to mishandling, malfunction, wear or corrosion.

Another object is a firing mechanism having a hammer safety in which a striker on the hammer is normally in a firing position, but the striker is shifted to a misaligned position so the gun cannot fire unless the trigger is intentionally pulled.

Another object is a firing mechanism having a hammer safety in which a striker on the hammer is normally in a firing position so the gun fires reliably when the trigger is intentionally pulled.

Another object is a firing mechanism having a hammer safety in which the safety mechanism parts do not engage during normal firing when the trigger is intentionally pulled so that the trigger pull characteristics are unaffected by the safety mechanism, and wear is minimized.

Another object is a hammer safety having a shiftable striker on the hammer in which the safety mechanism is inactive during intentional firing to minimize wear, and a safety arm associated with the trigger does not engage the striker until after the gun fires and the trigger is released.

A further object is a hammer safety in which the striker is pivoted to the hammer to move up and down, the striker has a head with a rear surface, the hammer has a front surface opposed to the rear surface of the striker head, and the pivot connection between the striker and the hammer is a loose fit so that the hammer force is transmitted to the striker by good surface to surface contact.

Preferred embodiments of the invention, which are hereinafter described in detail with reference to the drawings, are given as non-limiting examples of the invention.

DETAILED DESCRIPTION

Figure 1:
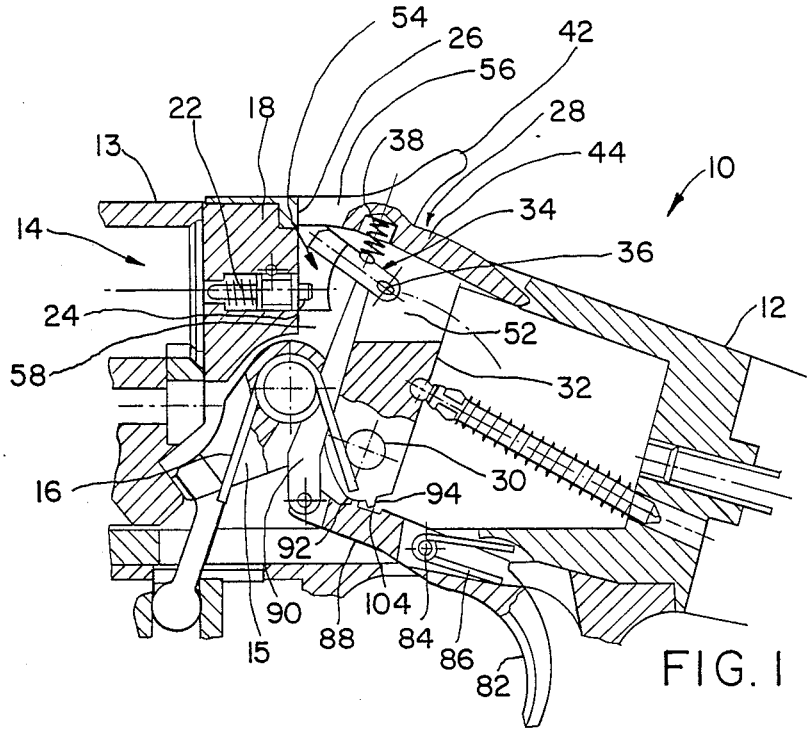
FIG. 1 is a partial side view in section of a firearm, and shows the relative positions of the parts of the hammer safety of the invention when the hammer is in its down or uncocked position, and the trigger is not pulled.

FIG. 1 shows a portion of a firearm 10 having a receiver or frame 12, and a barrel 13 having a chamber 14. The firearm 10 is a single barrel shotgun with the barrel 13 pivoted to frame 12. There is a conventional barrel lock mechanism 15 (partly show) including a spring 16. Operation of this mechanism 15 releases the barrel 13 so its rear or chamber end can pivot up relative to the receiver to open the gun for loading a shell into the chamber 14.

Mounted in the breech portion 18 of the frame is a firing pin 22 biased rearward by a spring so its rearward end 24 normally projects from the rear face 26 of the breech portion 18, as shown at FIG. 1.

A hammer assembly 28 is pivoted to the frame by a pivot pin 30, for movement toward and away from the firing pin 22. The hammer assembly includes a hammer body 32, and a striker 34 which is pivoted to the hammer body with a pin 36, and is urged downwardly by a compression spring 38, as shown at FIGS. 1, 2, and 7.

The hammer body 32 is of integral construction (FIG. 7) and has an upwardly projecting spur 42 and a tang or extension 44 behind spur 42. Hammer body 32 is of uniform width between its parallel side surfaces 46 and 48 (FIG. 7), and has a vertical pocket or slot 52 formed in its mid-plane which extends downwardly from just below extension 44 (FIGS. 1 and 7). There is a recess 54 in the front face of the hammer, bounded by an upper lug 56 and a pair of lower lugs 58 through which the slot 52 extends.

Figure 2:
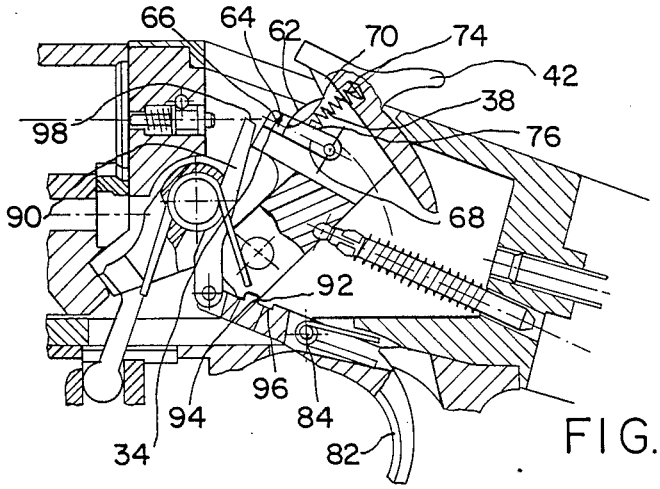
FIG. 2 shows, on a smaller scale, the hammer safety when the hammer is cocked.
Figure 6:
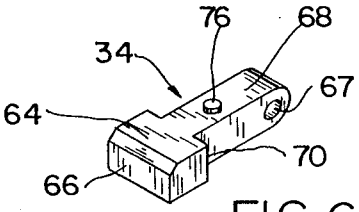
FIG. 6 is an enlarged pictorial view of the striker.
Figure 7:
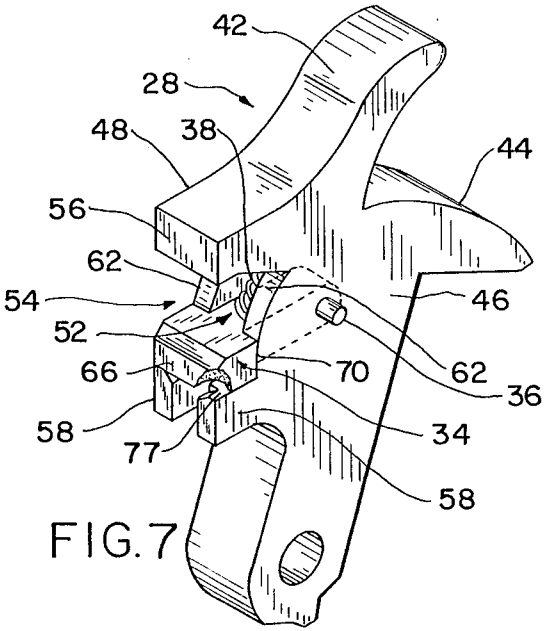
FIG. 7 is an enlarged pictorial view of the hammer assembly.

The front faces 62 of the hammer body in the recess 54 have a convex curvature about the axis of the striker pivot pin 36, as shown at FIGS. 2 and 7. Striker 34 (FIGS. 2 and 6) has an enlarged head 64 with a flat front face 66, and an elongated narrower shank or mounting leg 68, provided with a transverse opening 67 to receive the pin 36. The rear surfaces 70 of the striker head, which project sideways beyond the shank are concave and curve about the axis of pin 36. Thus, the surfaces 70 and 62 are of the same radius of curvature so the striker can pivot up and down on the hammer body, in the recess 54. The pivot pin opening 67 is slightly elongated axially of shank 68 so that the rear faces 70 can seat on the front faces 62 in good surface to surface contact when force is applied to the striker by the hammer.

The upper end of spring 38 fits in a seat 74 (FIG. 2) below spur 42, and the lower end of the spring receives a boss 76 on the top of the shank 68 of the striker (FIG. 6). Spring 38 presses striker 34 against the upper surfaces 77 of lugs 58, during normal firing.

A trigger 82 is pivoted to the frame by a pin 84, and is urged to the released position of FIG. 1 by a torsion spring 86. The trigger has a forward extension 88 to which a safety arm 90 is pivotally connected. The top face of the trigger extension has a sear or catch 92 adapted to engage a hammer projection 94 at the lower end of the hammer to hold the hammer in its cocked position, as shown as FIG. 2. There is a recess 96 behind the sear 92.

The barrel locking mechanism 15 is slotted to enable the safety arm 90 to extend upwardly in front of the hammer body and into the slot 52, and to maintain the arm 90 in a position aligned with the slot 52.

As shown at FIG. 2, the safety arm 90 has an upper end 98 which extends at an angle to and across the path of travel of the striker, when the trigger is released.

It will be seen from FIGS. 1 and 2 that the striker 34 is mounted on the hammer body for pivotal movement between the active position of FIG. 2, and the inactive or mis-aligned position of FIG. 1, to which it is moved by the action of the safety arm 90, in a manner which will soon be described.

OPERATION

FIG. 1 shows the hammer and safety just after a shell is fired and the trigger 82 is released. Upon release of the trigger, its return spring 86 pushes the safety arm upwardly to engage and pivot the striker 34 up to a position above the end 24 of the firing pin, against the action of the weaker striker spring 38. This is the normal rest position of the hammer and the striker 34, during and after reloading, i.e. when the hammer is down. Since the striker 34 is above and mis-aligned with the firing pin, the gun will not fire if the spur 42 of the hammer is bumped, as can happen if the gun is dropped.

When the hammer is cocked to the position of FIG. 2, which is usually done by pulling back on the spur 42 with the thumb, sear 92 catches the hammer projection 94 to hold the hammer in the cocked position. If the thumb slips off the spur 42 as the hammer is pulled back but before it catches the sear, the tip 98 of the safety arm will engage the underside of the striker 34 as the hammer falls and push the striker to the mis-aligned position of FIG. 1 before the striker can impact the end 24 of the firing pin. Thus, the gun will not fire if the hammer slips while it is being cocked.

Figure 3:
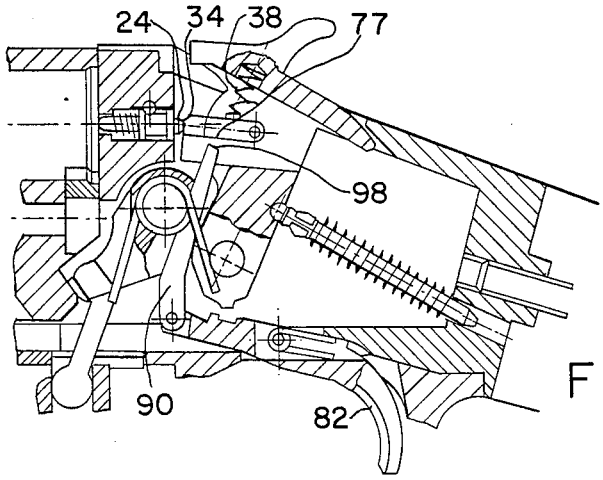
FIG. 3 shows the hammer falling from the position of FIG. 2, at the moment of impact of the striker with the firing pin during intentional firing while the trigger is pulled.
Figure 4:
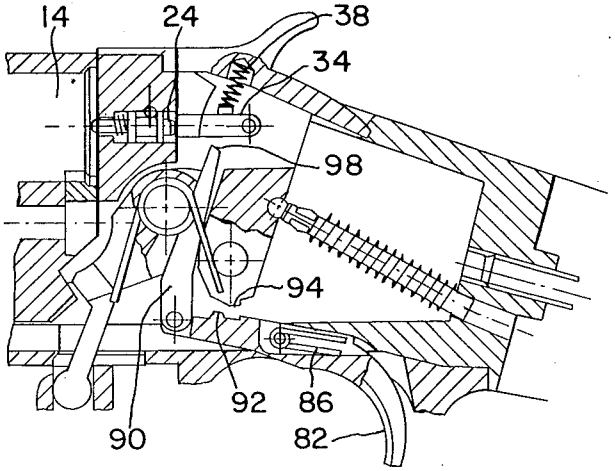
FIG. 4 shows the firing pin fully depressed by the striker during intentional firing while the trigger is still pulled.

FIG. 3 and 4 show the firing action sequence when the trigger 82 is intentionally pulled to release the hammer from the cocked position of FIG. 2. When trigger 82 is pulled, the sear 92 moves down and releases from the projection 94 of the hammer, and the tip 98 of safety arm 90 is simultaneously withdrawn to a position below the path of travel of the striker 34. Thus the striker remains in its active position and will strike or impact the end 24 of the firing pin as shown at FIG. 3.

With the trigger still pulled and the safety arm 90 retracted, the striker 34 drives the firing pin forward to discharge a live shell (not shown) in the chamber 14, and fire the gun. It is to be noted that there is no engagement of the safety arm 90 with the striker 34 during such normal or intentional firing which assures reliable firing, and avoids wear of the striker and the tip 98 of the safety arm.

It is not until the trigger is released, after firing, that the arm 90 moves up under the action of the trigger return spring and forces the striker to the mis-aligned position of FIG. 1.

Figure 5:
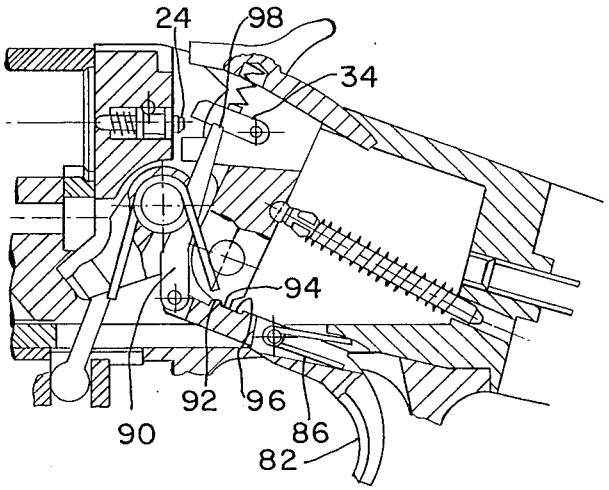
FIG. 5 is a view similar to FIG. 3, but shows the safety action which occurs if the hammer is accidentally released.

It will be seen from FIGS. 1 and 5 that after firing, and then releasing the trigger, the projection 94 of the hammer moves into the recess 96 of the trigger behind the sear 92, and there is a space 104 between the rear of the sear and the front of the projection.

The purpose of this space or clearance 104 is to prevent firing if the hammer is accidentally released from the cocked position of FIG. 2. Such safety action is shown at FIG. 5. The difference between FIG. 3 and FIG. 5 is that the manual pull is not maintained on the trigger 82, in the operation shown at FIG. 5. As a result, the trigger snaps back to its released position, under the action of its return spring, while the hammer is falling, as soon as the projection 94 on the hammer moves past the sear 92, so that the projection can move into the recess 96. As shown at FIG. 5, the striker 34 is then engaged by the tip 98 of the safety arm, while the hammer is still falling, and is moved up to the mis-aligned position of FIG. 5 so that the striker misses the firing pin and the gun does not fire.

This action of the striker missing the firing pin occurs whenever the hammer falls and a pull is not maintained on the trigger. Thus, if the hammer is released as a result of inertial forces, for example, if the gun is bumped or dropped, the safety arm moves the striker to the non-firing position of FIG. 5, before the head 66 of the striker arrives at the firing pin.

When the striker 34 is in its mis-aligned position it is contained in the recess 54 between the upper lug 56 and the lower lugs 58 of the hammer. The relative dimensions of the hammer and striker are such that the striker 34 does not engage the rear face 26 of the breech during either normal firing or when the hammer is accidentally released. During normal firing, the striker 34 engages the head 24 of the firing pin to drive the pin forward, but forward motion of the hammer is arrested by engagement of hammer lugs 54 and 56 with the rear surface 26 of the breech. When the hammer falls and the striker is in the mis-aligned (non firing) safety position of FIG. 5, forward motion of the hammer is again arrested when the hammer lugs 56 and 58 engage the rear face 26 of the breech. Since the striker cannot hit the breech, damage to the striker is avoided. The lower lugs 58 can be very slightly shorter than the upper lug 56, so the upper lug receives most of the impact to stop the hammer.

While a preferred embodiment has been shown and described, variations and changes can be made without departing from the scope of the invention. For example, instead of providing a recess in the front face of the hammer, the rear face of the breech or receiver can be recessed to accommodate the firing pin and the striker.

While the preferred embodiments have described the hammer safety as used with a shotgun, the safety can be adapted for and used with other types of guns such as rifles, revolvers and pistols.

I claim:

1. A hammer safety for a firearm comprising, a hammer movable from a rearward position to a forward position, a striker, means mounting said striker on said hammer for movement between a lower active impact delivering firing position and an upper inactive non firing position, said striker being normally in said active position, trigger means for releasing said hammer from said rearward position in response to a pull on said trigger means, spring means for normally maintaining said trigger means in a released position, striker engaging safety means movable to an operative position in the path of travel of said striker when the trigger means is released for engaging and moving said striker to said upper inactive non firing position before the hammer moves to said forward position so the firearm will not fire, said striker engaging safety means being movable to an inoperative position out of the path of travel of the striker in response to pulling said trigger means so that the striker remains in said lower active firing position to discharge the firearm when the trigger means is intentional pulled.

2. A hammer safety according to claim 1 further comprising, spring means for normally urging said striker to said active position.

3. A hammer safety according to claim 1 wherein, said means mounting said striker on said hammer comprises means mounting the striker for pivotal movement on the hammer between said active and inactive positions, and further comprises, spring means for normally urging said striker to said active position.

4. A hammer safety according to claim 1 further comprising, a firing pin in the path of travel of said striker when said striker is in said active position, so that when the trigger means is intentionally pulled said striker impacts against said firing pin to discharge the firearm, and wherein, when said trigger means is released, said safety means engages and moves said striker to said inactive position in which the striker misses the firing pin so that the firearm does not discharge 5. A hammer safety comprising, a frame, a hammer mounted on the frame for movement from a rearward position to a forward position, a striker, means pivotally mounting said striker on said hammer for movement between an active impact delivering firing position and an inactive non firing position, means for urging said striker toward said active position, a trigger supported by the frame, means associated with the trigger for releasing said hammer from said rearward position in response to a pull on said trigger, spring means for normally maintaining said trigger in a released position, a safety arm connected to said trigger, said safety arm engaging said striker to move said striker to said inactive position when said trigger is released so the firearm will not fire, said safety arm being movable to an inactive position out of the path of travel of the striker, in response to pulling said trigger, so that the striker is in said firing position to discharge the firearm when the trigger is intentionally pulled.

6. A hammer safety according to claim 5 wherein, said striker comprises a head on a forward portion of said hammer, said head having a front striking face and a rear surface in front of a surface of the hammer, said surface of the hammer engaging said rear surface of said head to transmit hammer force to said front striking face.

7. A hammer safety according to claim 6 wherein, said rear surface of said head and said surface of said hammer curve about substantially the same axis so that the hammer force is transmitted to said head by surface to surface contact between said hammer and said striker.

8. A hammer safety according to claim 7 wherein, said means pivotally mounting said striker on said hammer comprises a loose fit connection between said hammer and said striker to enable said curved rear surface of the striker head to seat on said curved surface of said hammer.

9. A hammer safety according to claim 5 wherein, said striker is mounted on said hammer for pivotal movement between a lower active position and an upper inactive position, said hammer comprises a striker seat engageable with a downwardly facing surface of the striker, and said spring means comprises a compression spring for urging said striker toward said active position and against said seat.

10. A hammer safety according to claim 9 wherein, said trigger has an extension, said safety arm is pivotally connected to said extension, and said arm engages a downwardly facing surface of said striker to pivot the striker to its upper inactive position when the trigger is released.

11. A hammer safety according to claim 10 wherein, said safety arm, when said trigger is pulled, is retracted below said striker to enable said compression spring to hold said striker in its active position against said seat.

12. A hammer safety according to claim 10 wherein, said safety arm, when said trigger is released, is in the path of travel of said striker and engages said striker to move the striker to the mis-aligned non-firing position.

* * * * *